US008342834B2

(12) United States Patent
Stündl et al.

(10) Patent No.: US 8,342,834 B2
(45) Date of Patent: Jan. 1, 2013

(54) METHOD AND APPARATUS FOR SPINNING AND CRIMPING A SYNTHETIC MULTIFILAMENT YARN

(75) Inventors: Mathias Stündl, Wedel (DE); Diethard Hübner, Bordesholm (DE)

(73) Assignee: Oerlikon Textile GmbH & Co., KG, Remscheid (DE)

( * ) Notice: Subject to any disclaimer, the term of this patent is extended or adjusted under 35 U.S.C. 154(b) by 1853 days.

(21) Appl. No.: 11/181,161

(22) Filed: Jul. 14, 2005

(65) Prior Publication Data

US 2005/0242461 A1 Nov. 3, 2005

Related U.S. Application Data

(63) Continuation of application No. PCT/EP03/02345, filed on Mar. 7, 2003.

(30) Foreign Application Priority Data

Jan. 15, 2003 (DE) ..... 103 01 212

(51) Int. Cl.
*B29C 47/00* (2006.01)

(52) U.S. Cl. ..... 425/377

(58) Field of Classification Search ..... 425/377, 425/378.2, 382.2
See application file for complete search history.

(56) References Cited

U.S. PATENT DOCUMENTS

| | | | | |
|---|---|---|---|---|
| 5,974,777 | A | 11/1999 | Davis | |
| 6,305,059 | B1 * | 10/2001 | Mayer | 28/248 |
| 2001/0038159 | A1 * | 11/2001 | Maranca et al. | 264/103 |
| 2004/0031134 | A1 * | 2/2004 | Koslowski et al. | 28/263 |
| 2004/0200048 | A1 * | 10/2004 | Hubner | 28/263 |

FOREIGN PATENT DOCUMENTS

| | | | |
|---|---|---|---|
| DE | 42 24 454 | A1 | 2/1993 |
| DE | 196 13 177 | A1 | 10/1996 |
| JP | 9-511553 | A | 11/1997 |
| WO | WO 96/23916 | A1 | 8/1996 |
| WO | WO 01/64982 | * | 9/2001 |
| WO | WO 01/64982 | A2 | 9/2001 |
| WO | WO 02/090632 | * | 11/2002 |
| WO | WO 02/090632 | A1 | 11/2002 |

* cited by examiner

*Primary Examiner* — Larry Thrower
(74) *Attorney, Agent, or Firm* — Alston & Bird LLP

(57) ABSTRACT

A method and an apparatus for spinning and crimping a synthetic multifilament yarn, wherein a filament bundle is spun from a polymer melt and compressed to a yarn plug. The yarn plug is advanced at a cooling speed and cooled within a cooling zone in a moving cooling groove. After cooling, the yarn plug is disentangled to form a crimped yarn, with the latter being wound to a package. To obtain an adequate cooling of the yarn plug and, with that, a stable and highest possible crimp in the yarn, the method of the invention provides for selecting the length of the cooling zone and the cooling speed of the yarn plug such that the yarn plug is cooled in the cooling groove over a period of at least 1 second. To this end, the apparatus of the invention includes a cooling groove, whose width is dimensioned such that the yarn plug can be advanced in meander form in a plurality of superposed layers.

4 Claims, 5 Drawing Sheets

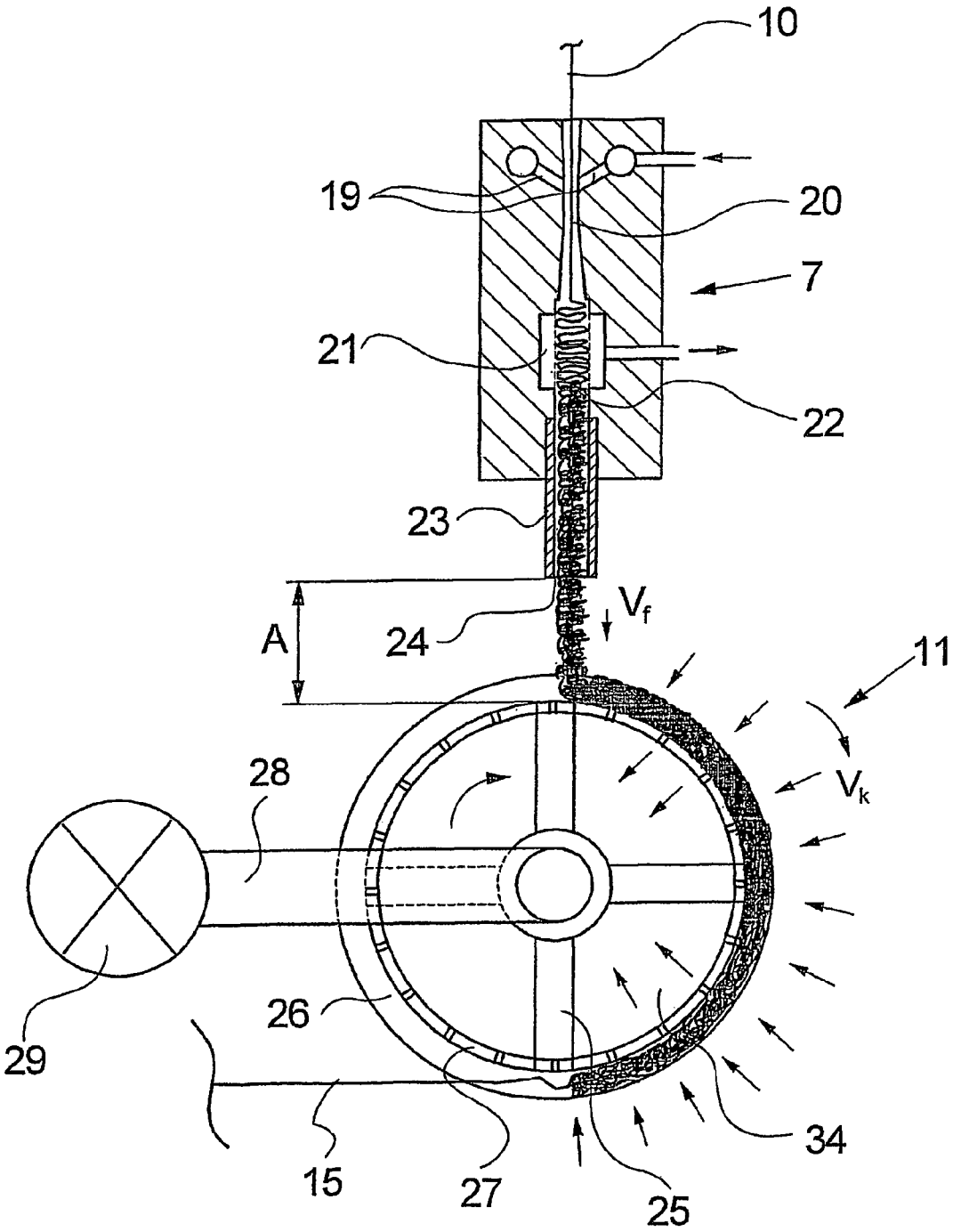
Fig.2.1

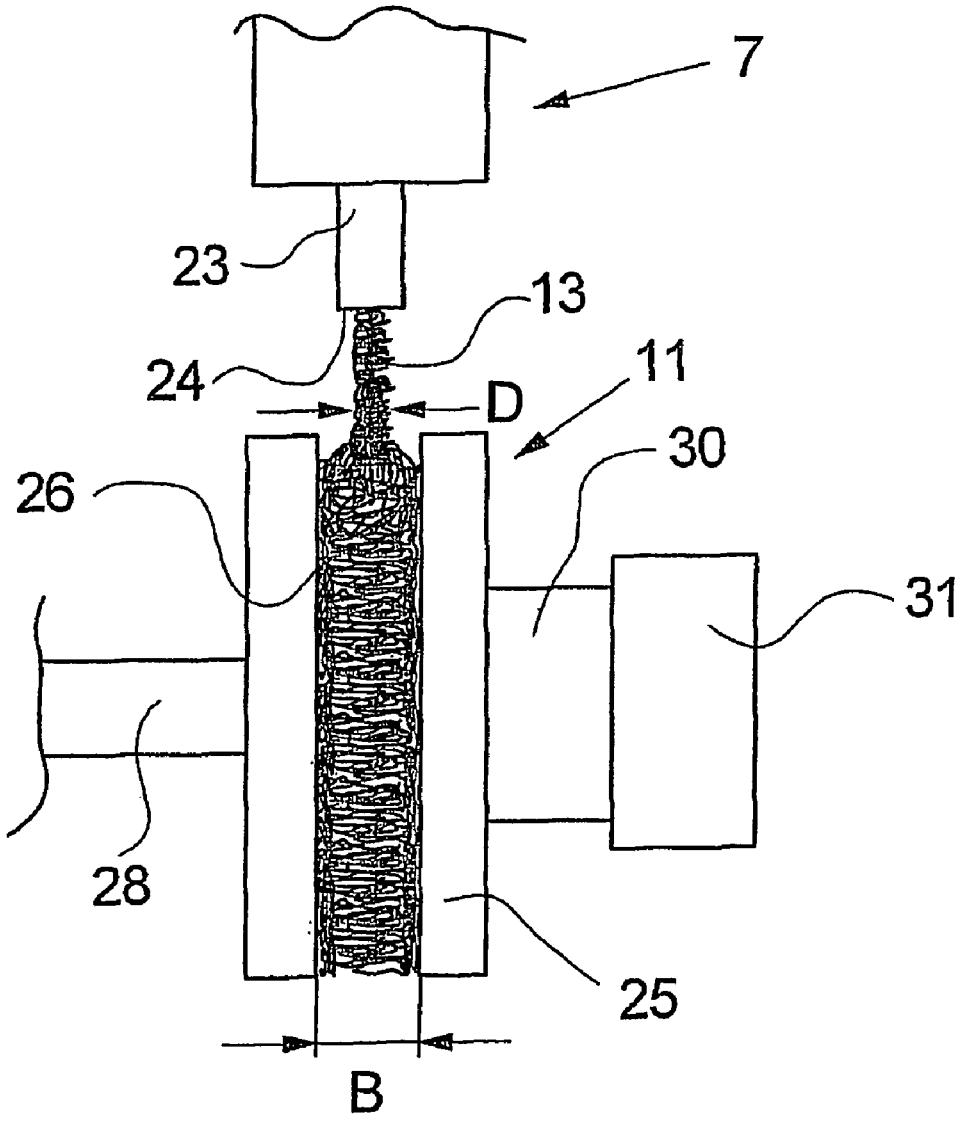
Fig.2.2

METHOD AND APPARATUS FOR SPINNING AND CRIMPING A SYNTHETIC MULTIFILAMENT YARN

CROSS REFERENCE TO RELATED APPLICATION

The present application is a continuation of international application PCT/EP2003/002345, filed Mar. 7, 2003, and which designates the U.S. The disclosure of the referenced application is incorporated herein by reference.

BACKGROUND OF THE INVENTION

The invention relates to a method for spinning and crimping a synthetic multifilament yarn, as well as an apparatus for spinning and crimping a synthetic multifilament yarn.

In the production of a crimped yarn, a plurality of strand-like filaments are extruded in a first step from a thermoplastic melt by means of a spin unit. After cooling, the filament bundle is combined and subsequently compressed to a yarn plug by means of a crimping device. In this process, the filaments of the filament bundle are deformed in the yarn plug to loops and coils by means of a preferably heated fluid. To realize such a deformation of the filaments, the crimping device includes a stuffer box chamber, in which the conveying medium compresses the filament bundle to the yarn plug. Thus, the desired loops and coils of the individual filaments form, as the filaments impact upon the yarn plug inside the stuffer box chamber.

To obtain as much as possible a stable crimp, it is preferred to advance the yarn through a heated conveying medium and to heat it at the same time, so that a plastic deformation is able to occur in the individual filaments. To set the crimp, the yarn plug advances through a cooling zone. The cooling zone is formed by a cooling groove preferably on the circumference of a rotating cooling drum. In this arrangement, the length of the cooling zone is defined by the diameter of the cooling drum and by a partial looping on the circumference of the cooling drum. During the cooling, the cooling drum is driven for rotation, so that the circumferential speed of the cooling groove equals the cooling speed of the yarn plug, at which the yarn plug advances through the cooling zone. A method and an apparatus of this type for spinning and crimping a synthetic multifilament yarn are disclosed, for example, in DE 196 13 177 A1.

According to DE 196 13 177 A1, a most effective and uniform cooling of the yarn plug requires a defined duration of the cooling. Thus, the art proposes to increase the dwelling time in that the yarn plug advances with a partial looping over a second, subsequent cooling drum. With that, however, it is not possible to achieve an uninterrupted, uniform cooling of the yarn plug, since the transition from the first cooling drum to the second cooling drum represents each time an undefined interruption of the cooling process.

U.S. Pat. No. 5,974,777 discloses a method and an apparatus for cooling a yarn plug, wherein the yarn plug advances with several loopings over the circumference of a cooling drum. While this procedure permits achieving longer dwelling times for cooling the yarn plug even at higher process speeds, it has the disadvantage that the combined yarn plugs interfere with one another on the circumference of the cooling drum, so that, for example, individual filaments of adjacent plugs interlock and lead to undesired filament breaks upon disentanglement of the plugs. In addition, it is necessary to displace the yarn plugs on the cooling drum surface, so that additional shearing forces act upon the plug. Furthermore, such a displacement on the circumference of the cooling drum may cause individual filaments to interlock on the cooling surface.

It is therefore an object of the invention to further develop a generic type of method and apparatus for spinning and crimping a synthetic multifilament yarn such that after cooling the yarn plug, it is ensured that a stable and high crimp of the yarn is achieved irrespective of the production speed.

SUMMARY OF THE INVENTION

The invention is based on the discovery that the dwelling time of the yarn plug within the cooling zone or in the cooling groove is the decisive parameter for cooling the yarn plug. Known as further parameters for cooling the yarn plug are the temperature difference between the yarn plug and the cooling medium as well as the volume flow of the cooling medium. However, the influence of these parameters is small in proportion with the duration of the cooling. For example, in tests with a textured yarn of a polyamide PA6 it was possible to find that duplicating the time from 0.25 seconds to 0.5 seconds resulted in an improvement of the crimp of about 10%. A further duplication of the cooling period from 0.5 seconds to 1 second allowed to achieve a further improvement of the crimp of 4%. This asymptotic behavior between dwelling time and crimp applies to all types of polymers. Thus, the length of the cooling zone and the cooling speed of the yarn plug are decisive parameters for the cooling period of the yarn plug. The method of the invention is characterized in that the length of the cooling zone and the cooling speed of the yarn plug are proportionate to each other, so that the yarn plug is cooled in the cooling groove over a period of at least one second. This ensures a substantially complete cooling of the yarn plug, so as to permit attaining a high degree of crimp in the yarn.

In making further use of the asymptotic behavior between the duration of the cooling and the crimp of the textured yarn, the length of the cooling zone and the cooling speed of the yarn plug are preferably selected such that the yarn plug is cooled on the circumference of the cooling drum over a period of at least two seconds.

In this process, there basically exist two possibilities of maintaining the ratio of the length of the cooling zone to the cooling speed of the yarn plug, which is decisive for cooling the yarn plug. Thus, a predetermined cooling speed permits varying the length of the cooling zone, or a predetermined length of the cooling zone permits changing the cooling speed of the yarn plug. The cooling length is largely defined by the constructional condition of the cooling groove that is provided for receiving the yarn plug, and is often limited by an allowed space. However, to maintain even in the case of relatively short cooling zones, the decisive ratio of length of the cooling zone to cooling speed of the yarn plug, it is preferred to use the variant of the method, wherein the yarn plug advances before cooling at a yarn advancing speed, and during the cooling at a cooling speed, with the cooling speed being lower than the yarn advancing speed. Thus, more yarn plug material advances to the cooling zone per unit time. Consequently, the greater the difference is between the yarn advancing speed and the cooling speed, the longer the period for cooling the yarn plug.

With the use of the advantageous further development of the method according to the invention, wherein at the beginning of the cooling zone, the yarn plug is laid in the cooling groove in meander form, preferably in a plurality of superposed layers, it is possible to achieve a uniform filling of the groove and with that a uniform cooling of the yarn plug.

Preferably, the yarn plug is cooled by a cooling medium flow that penetrates the yarn plug. To this end, it is possible to generate the cooling medium flow by a source of vacuum. To intensify cooling, it also possible to use a source of overpressure to generate an additional cooling medium flow, which is blown, for example, as cooling air, onto the yarn plug.

The method of the invention is characterized by a clearly increased crimp in the yarn. A carpet produced from such a yarn exhibited a high cover ability without any streak or cloud formation.

The method of the invention is suited for all polymer types, such as, for example, PA and PP.

To be able to carry out the method of the invention, the apparatus of the invention has been found particularly suitable, and wherein the width of the cooling groove for receiving and advancing the yarn plug is dimensioned such that the yarn plug is allowed to advance in meander form in a plurality of superposed layers. This allows to ensure an intensive cooling of the yarn plug even at high process speeds, since the yarn advancing speed can be adjusted substantially higher than the cooling speed of the yarn plug.

To achieve a uniform filling of the cooling groove, a spacing is adjusted between the outlet of the texturing device and the cooling groove, with the width of the cooling groove being at least twice as large as the diameter of the yarn plug.

Basically, the cooling groove can be provided on a belt-type carrier, or according to an advantageous further development of the invention, on the circumference of a cooling drum. This construction permits controlling the cooling speed for advancing the yarn plug in a simple manner by the drive of the cooling drum.

Preferably, a source of vacuum is associated to the cooling drum, which permits generating a cooling medium flow that penetrates the yarn plug and the screen-type bottom of the cooling groove.

For additionally cooling the yarn plug inside the cooling groove, an additional blower with a source of overpressure may be associated to the cooling drum, which permits generating an additional cooling medium flow that is directed into the cooling groove and onto the yarn plug.

BRIEF DESCRIPTION OF THE DRAWINGS

In the following, the method of the invention is described in greater detail by reference to preferred embodiments of the apparatus according to the invention. In the drawing:

FIG. 2.1 is a schematic fragmentary side view of the embodiment of FIG. 1;

FIG. 2.2 is a schematic end view of the crimping device and the cooling device as shown in FIG. 2.1;

DETAILED DESCRIPTION OF THE PREFERRED EMBODIMENTS

Figure 1:
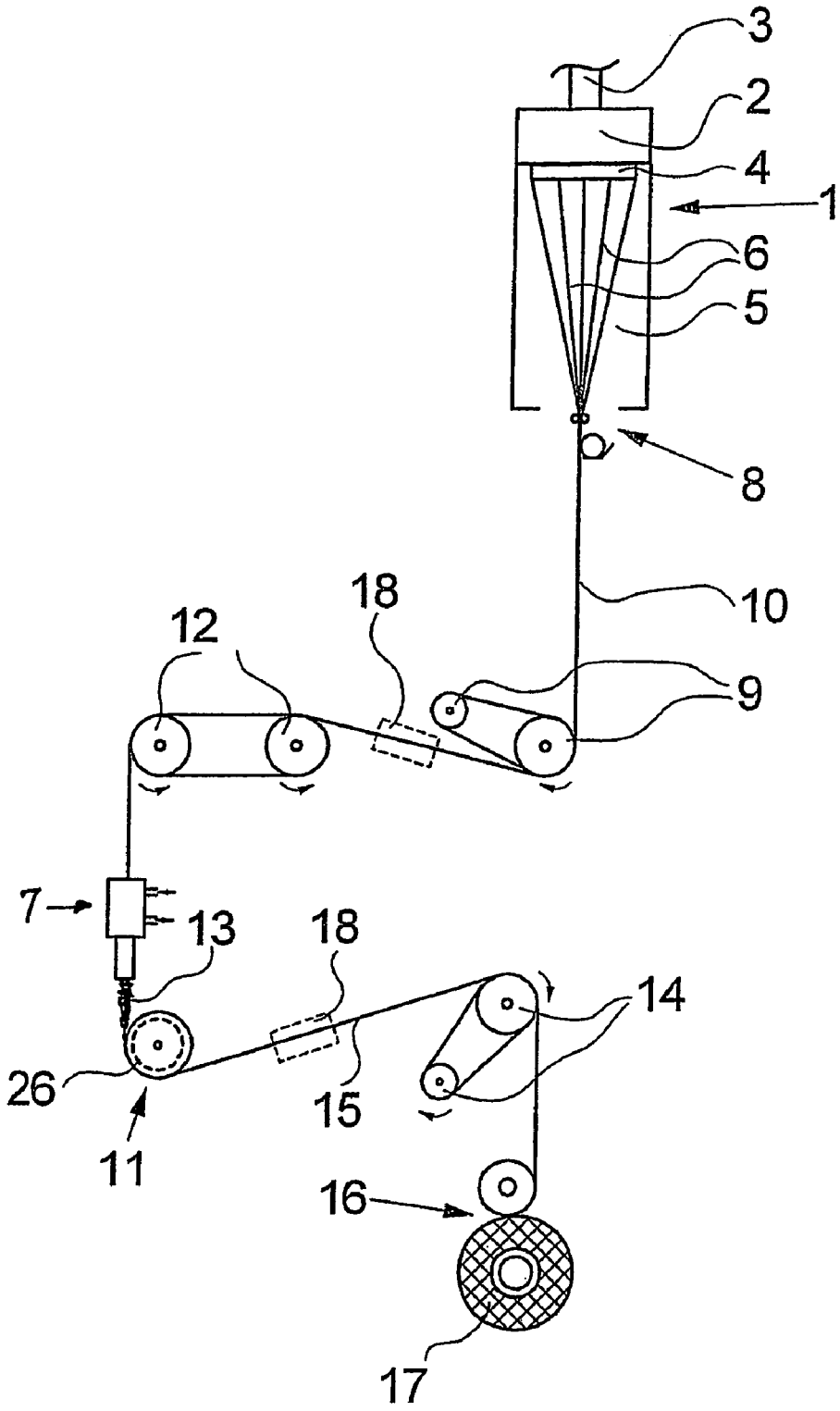
FIG. 1 is a schematic view of a first embodiment of the apparatus according to the invention.

FIG. 1 schematically illustrates a first embodiment of an apparatus according to the invention for carrying out the method of the invention. The apparatus comprises a spin unit 1 that connects via a melt supply line 3 to a melt producer, for example, a pump or an extruder (not shown). The spin unit 1 contains a spin head 2 which mounts on its underside at least one spinneret 4. The spinneret 4 includes a plurality of spin holes, through which a polymer melt supplied to the spin head 2 is extruded under pressure to a plurality of individual filaments 6. Downstream of the spin unit 1, a cooling shaft 5 is provided, through which the filaments 6 advance, so that the filaments emerging at approximately the melt temperature are cooled. To this end, the cooling shaft 5 could be connected, for example, to a cross-flow quench system, which blows a cooling air substantially crosswise to the filaments 6.

In the outlet region of the cooling shaft 5, a yarn guide and a yarn lubrication device 8 extend. The yarn lubrication device 8 applies to the filaments 6 a lubricant, so that the filaments 6 combine to a filament bundle 10. A yarn feed godet unit 9 downstream of the cooling shaft 5 withdraws the filament bundle 10 from the spinneret 4, and advances it to a subsequent draw godet unit 12. From the draw godet unit 12, the filament bundle 10 enters a crimping device 7. In the crimping device 7, the previously drawn filament bundle 10 is compressed to a yarn plug 13.

Arranged downstream of the crimping device 7 is a cooling device 11 with a moving cooling groove 26. The cooling groove 26 serves to receive and cool the yarn plug 13. The construction and operation of the cooling device 11 will be described in greater detail in the following. To disentangle the yarn plug 13, a withdrawal godet unit 14 withdraws the crimped yarn 15, and advances it to a takeup unit 16. In the takeup unit 16, the crimped yarn 15 is wound to a package 17.

The construction and arrangement of the individual units of the embodiment shown in FIG. 1 are exemplary. For example, it is possible to supplement, exchange, or replace the treatment devices and guide elements. To produce a yarn cohesion of the filaments or the crimped filaments, it is possible to arrange an entanglement device 18 upstream and/or downstream of the crimping device.

The embodiment of the apparatus according to the invention as shown in FIG. 1 is particularly suited for producing carpet yarns. To this end, it is necessary that the crimped yarn have a crimp that is adequate for final processing. Thus, the crimping device 7 and the cooling device 11 downstream thereof represent an important treatment step, which will be described in greater detail in the following.

FIG. 2.1 illustrates a fragment of the embodiment of FIG. 1, and is a schematic cross sectional view of the crimping device 7 and the subsequent cooling device 11. FIG. 2.2 is a schematic end view of the units. Unless specific reference is made to one of the Figures, the following description will apply to both Figures.

FIGS. 2.1 and 2.2 illustrate the crimping device 7 and the cooling device 11 downstream of the crimping device 7 of the embodiment of the apparatus according to the invention as shown in FIG. 1. The crimping device 7 comprises a nozzle-shaped yarn feed channel 20. The yarn feed channel 20 essentially consists of two sections, which are separated from each other by a narrowest cross section. In a first section, a short distance upstream of the narrowest cross section, the nozzle holes of an injector 19 extend into the yarn feed channel 20. The injector 19 connects to a source of fluid (not shown). In the second section, downstream of the narrowest cross section, the yarn feed channel 20 widens and ends in a directly following stuffer box chamber 22.

In the inlet region of the stuffer box chamber 22, the wall of the stuffer box chamber is made air permeable, and arranged inside a pressure relief chamber 21. Downstream of the pressure relief chamber 21, the stuffer box chamber 22 continues in the form of a discharge channel 23 having a substantially unchanged cross section. The end of the discharge channel 23 forms a plug outlet 24.

The cooling device 11 is constructed as a rotatable cooling drum 25. The cooling drum 25 is driven at a circumferential speed via a drive shaft 30 by a drive 31 (FIG. 2.2). To receive the yarn plug 13 produced by the crimping device 7, the cooling drum 25 comprises a cooling groove 26 that extends over its circumference. A bottom 27 of the cooling groove 26 is made air permeable, so that a cooling medium flow that is preferably generated from the outside inward, penetrates and cools the yarn plug 13 advancing in the cooling groove 26. To this end, a pressure chamber 34 is formed in the interior of the cooling drum 25, which connects via a suction line 28 to a source of vacuum 29. With that, the ambient air outside the cooling drum 26 is used as medium for cooling.

The cooling groove 26 formed on the circumference of the cooling drum 25 has a width B. The width B of the cooling groove 26 is dimensioned in relation to the yarn plug 13 such that the width B is preferably greater than twice the amount of the yarn plug diameter D, i.e., B>2D.

Between the plug outlet 24 and the cooling groove 26, a free spacing A extends to permit an unobstructed deposit of the yarn plug 13 in the cooling groove 26. During the crimping process, the spacing A remains unchanged.

In the crimping device 7, a heated conveying fluid enters the yarn feed channel 20 via the injector 19. This causes a suction effect to develop at the upper end of the yarn feed channel 20, which sucks the filament bundle 10 into the crimping device 7. The conveying fluid advances the filament bundle 10 through the yarn feed channel 20 into the stuffer box chamber 22. In the stuffer box chamber 22, the filament bundle 10 compacts to a yarn plug 13. In so doing, the filament bundle 10 opens up, and the individual filaments come to lie on top of one another in loops and coils. In this process, the formation of the yarn plug 13 is largely defined by the quality of the conveying fluid and by the pressure of the conveying fluid. As conveying fluid it is preferred to use hot air. To decrease the pressure of the conveying fluid, the upper region of the stuffer box chamber 22 is made air permeable in the form of air slots or lamellas, so that the conveying fluid is able to escape into a pressure relief chamber 21 and from there to the outside.

The yarn plug 13 advances at a defined, adjusted speed $v_F$ through the stuffer box chamber 22 to the plug outlet 24. From there, the yarn plug 13 enters the cooling groove 26 at the yarn advancing speed $v_F$. The cooling groove 26 moves at a cooling speed $v_K$, which is defined by the circumferential speed of the cooling drum 25. The cooling speed $v_K$ is adjusted substantially lower than the yarn advancing speed $v_F$. As a function of the ratio of the yarn advancing speed to the cooling speed, the yarn plug 13 is deposited in the cooling groove 26 in multiple layers and in meander form because of the unobstructed advance. In this connection, the width B of the cooling groove 26 and the ratio of the yarn advancing speed to the cooling speed are adapted to each other such that they allow the yarn plug 13 to fill the cooling groove 26 uniformly.

The yarn plug 13 advances through the cooling zone on the circumference of the cooling drum 25. The cooling zone is defined by the degree of the looping of the yarn plug 13 on the cooling drum 25. In the embodiment of FIG. 2.1, the yarn plug 13 loops the cooling drum 25 at an angle of 180°. Within the cooling zone, the yarn plug 13 undergoes a cooling by the cooling medium flow that is generated from the outside inward. After cooling, the yarn plug 13 is disentangled at the end of the cooling zone to form the crimped yarn 15.

The length of the cooling zone is determined by the diameter of the cooling drum 25 and the degree of looping of the yarn plug 13 on the circumference of the cooling drum 25. Cooling drums 25 normally have a diameter from 0.3 to 0.6 m. In an example, a cooling drum with a diameter of 400 mm was used. With a looping angle of 180°, this resulted in a length of the cooling zone of about 0.6 m. The yarn advancing speed $v_F$ was 90 m/min. The cooling speed $v_K$ was adjusted to 20 m/min. This resulted in a cooling time of about 1.8 seconds for cooling the yarn plug. With that, it was ensured that the yarn plug underwent an intensive cooling after advancing through the cooling zone, and that the yarn 15 thus exhibited a stable and high crimp.

Figure 3:
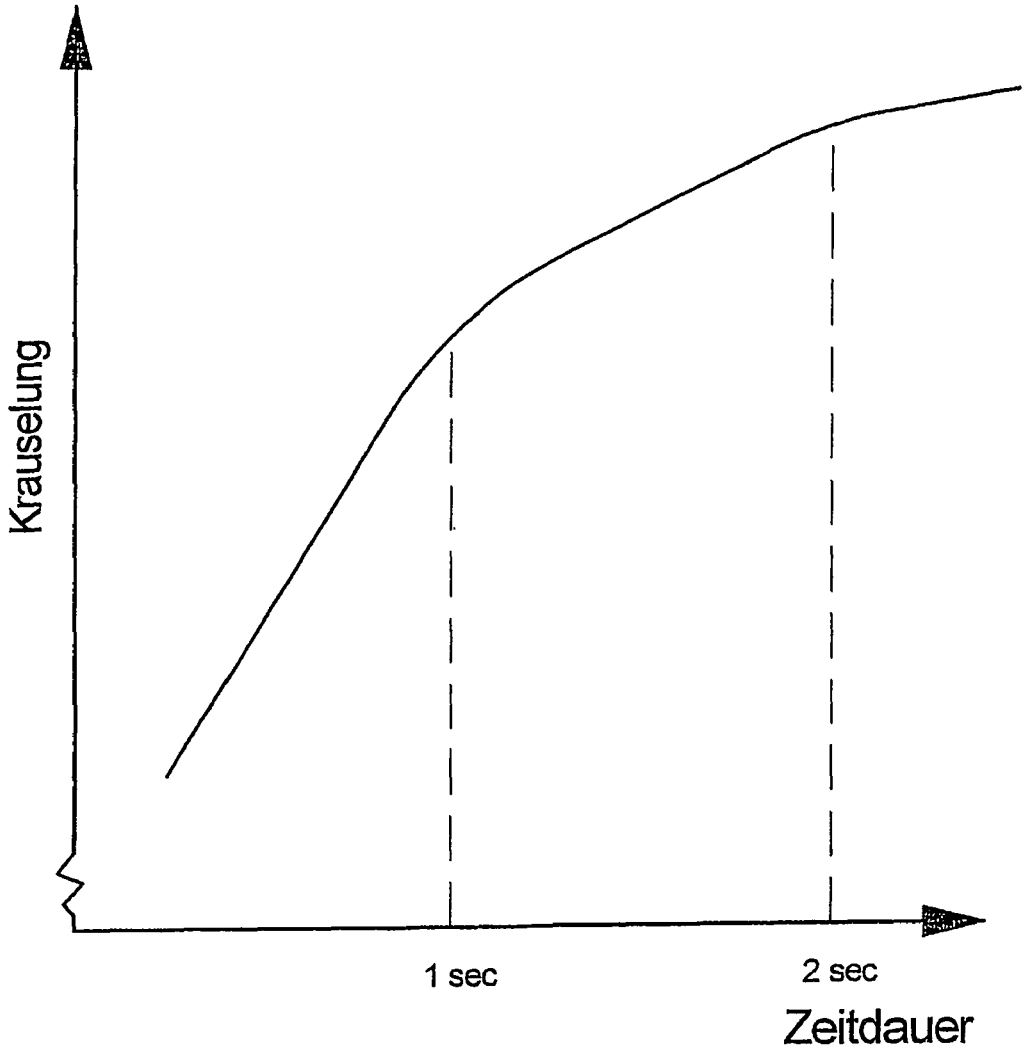
FIG. 3 is a schematic view of a diagram for illustrating the interdependence of the cooling period of the yarn plug and the crimp of the yarn.

In FIG. 3, a diagram illustrates the interdependence of time for cooling the yarn plug and the crimp in the produced crimped yarn. The illustrated slope of the curve makes it clear that in the range of less than 1 sec. cooling time, a high dependence exists between the cooling time and the crimp. As the cooling time increases, the curve becomes flatter to approximate asymptotically a limit value of the crimp. This relation between the cooling time and the crimp of the crimped yarn basically applies to all polymer types. In this respect, the method of the invention ensures that at a minimum cooling time of 1 second, preferably 2 seconds, a high degree of crimp is obtained in the produced yarn.

Tests with an additional cooling of the yarn plug by unheated air further resulted in that the positive effect of cooling with unheated air sets in only at longer dwelling times of about 0.5 seconds. Thus, the method of the invention accomplishes a maximum of crimp stability and crimp irrespective of the way of cooling the yarn plug.

Preferably, a uniform filling of the cooling groove 26 on the circumference of the cooling drum 25 is achieved. The multilayer deposit of the yarn plug in meander form is adjusted such that no significant gaps form within the cooling groove 26. This results in a uniform flow resistance and thus in a uniform cooling of the yarn plug. The deposit of the yarn plug can be influenced by additional guide elements. However, the random orientation of the yarn plug in the cooling groove can also be realized in a simple manner by adjusting the spacing A (FIG. 2.1) between the yarn plug outlet and the cooling groove, as well as by the selection of the width B of the cooling groove. The ratio of the yarn advancing speed $v_F$, at which the yarn plug advances before being cooled, to the cooling speed $v_K$, at which the yarn plug advances while being cooled, is in a range from $v_F/v_K$=0.1 to 0.4. With that, it is possible to realize even high production speeds of more than 3,000 m/min. (crimping speed) and a long dwelling time.

Figure 4:
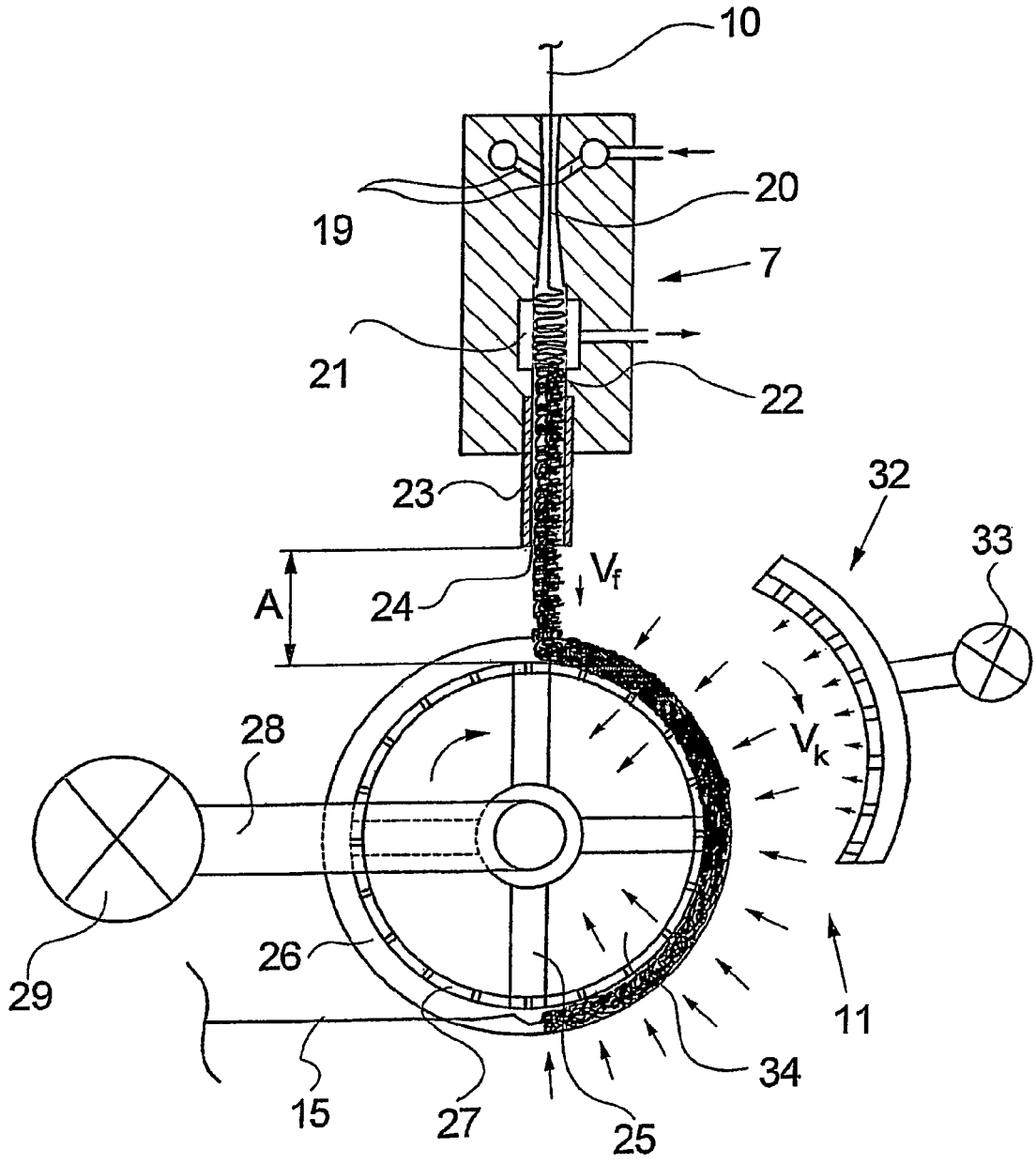
FIG. 4 is a schematic view of a further embodiment for cooling the yarn plug.

FIG. 4 schematically illustrates a modification of the cooling device of the embodiment of FIG. 1. In this modification, a blower 32 is arranged in spaced relationship with the cooling drum 25 in the region of the cooling groove 26, and connected to a source of overpressure 33. The blower 32 has an elongate shape that overlaps at least one section of the cooling zone. A cooling medium flow is generated by the source of overpressure 33 through a plurality of air outlets, and directed to the yarn plug 13 in the cooling groove 26.

The construction of both the crimping device 7 and the cooling device 11 is identical with the foregoing embodiment, so that the foregoing description may herewith be incorporated by reference.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for spinning and crimping a synthetic multifilament yarn, comprising a spin unit for spinning a filament bundle, a crimping device for compressing the filament bundle to form a yarn plug, a moveable cooling groove for receiving and advancing the yarn plug while being cooled, a takeup device for disentangling the yarn plug after cooling to form a crimped yarn and then winding the crimped yarn into a package, wherein the width (B) of the cooling groove is dimensioned so that the complete yarn plug can be advanced into the groove in meander form in a plurality of superposed layers, and a drive for driving the cooling groove with a circumferential speed that is slower than the advancing speed of the yarn plug, wherein a spacing (A) is determined between the outlet of the crimping device and the cooling groove, with the width (B) of the cooling groove being at least twice as large as the diameter (D) of the yarn plug.

2. The apparatus of claim 1, wherein the cooling groove is formed on the circumference of a cooling drum, and that a controllable drive is connected to the cooling drum to adjust a cooling speed for advancing the yarn plug.

3. The apparatus of claim 2, wherein a source of vacuum is connected to the cooling drum, which generates a cooling medium flow that penetrates the yarn plug and a screen-like groove bottom of the cooling groove.

4. The apparatus of claim 3, wherein a blower with a source of overpressure is connected to the cooling drum, which generates a cooling medium flow that is directed to the cooling groove and the yarn plug.

* * * * *